US011707759B2

(12) United States Patent
Naito et al.

(10) Patent No.: US 11,707,759 B2
(45) Date of Patent: Jul. 25, 2023

(54) COATING HEAD, COATING APPARATUS, AND COATING METHOD

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Katsuyuki Naito, Bunkyo (JP); Naomi Shida, Minato (JP); Kohei Nara, Yokohama (JP); Takahiro Kokubo, Hiratsuka (JP); Yutaka Saita, Yokohama (JP)

(73) Assignees: KABUSHIKI KAISHA TOSHIBA, Tokyo (JP); TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 57 days.

(21) Appl. No.: 17/445,735

(22) Filed: Aug. 24, 2021

(65) Prior Publication Data

US 2021/0387222 A1 Dec. 16, 2021

Related U.S. Application Data

(63) Continuation of application No. PCT/JP2020/009946, filed on Mar. 9, 2020.

(51) Int. Cl.
*B05C 1/08* (2006.01)
*B05C 11/10* (2006.01)
(Continued)

(52) U.S. Cl.
CPC ..... *B05C 1/0826* (2013.01); *B05C 1/04* (2013.01); *B05C 1/0804* (2013.01);
(Continued)

(58) Field of Classification Search
CPC ..... B05C 1/0826; B05C 11/10; B05C 1/04; B05C 1/0813; B05C 1/0873; B05C 1/0804; B05D 1/28
(Continued)

(56) References Cited

U.S. PATENT DOCUMENTS

2002/0121239 A1* 9/2002 Tonazzi ..... B05C 9/02 118/244
2010/0310778 A1* 12/2010 Shioi ..... B05B 12/122 118/313

FOREIGN PATENT DOCUMENTS

CN 207592089 U 7/2018
CN 108499756 A 9/2018
(Continued)

OTHER PUBLICATIONS

International Search Report dated Jun. 9, 2020 in PCT/JP2020/009946 filed on Mar. 9, 2020, 4 pages (with English Translation of Categories of Cited Documents).

*Primary Examiner* — Laura Edwards
(74) *Attorney, Agent, or Firm* — Oblon, McClelland, Maier & Neustadt, L.L.P.

(57) ABSTRACT

According to one embodiment, a coating head includes a coating bar, nozzles, a first member, second members, third members, elastic members, and a position controller. The coating bar faces a coating member. The nozzles supply a liquid toward the coating bar. The first member includes first recesses. A portion of the nozzles is between the first recesses and the third members. The portion of the nozzles and the third members are fixed to the first member by the second members. The elastic members are located in at least first, second, or third positions. The first position is between the third members and the second members. The second position is between the portion of the first recesses and the nozzles. The third position is between the portion of the
(Continued)

nozzles and the third members. The position controller controls a relative position between the coating bar and the nozzles.

20 Claims, 14 Drawing Sheets

(51) Int. Cl.
*B05C 1/04* (2006.01)
*B05D 1/28* (2006.01)

(52) U.S. Cl.
CPC ..... *B05C 1/0813* (2013.01); *B05C 1/0873* (2013.01); *B05C 11/10* (2013.01); *B05D 1/28* (2013.01)

(58) Field of Classification Search
USPC ..... 118/304, 313, 708
See application file for complete search history.

(56) References Cited

FOREIGN PATENT DOCUMENTS

| | | | | |
|---|---|---|---|---|
| JP | 09-019657 | A | | 1/1997 |
| JP | 2006-256051 | A | | 9/2006 |
| JP | 2011-206715 | A | | 10/2011 |
| JP | 2016-155113 | A | | 9/2016 |
| JP | 2016-155114 | A | | 9/2016 |
| JP | 2016-174992 | A | | 10/2016 |
| WO | WO2006095669 | | * | 9/2006 |

* cited by examiner

COATING HEAD, COATING APPARATUS, AND COATING METHOD

CROSS-REFERENCE TO RELATED APPLICATIONS

This is a continuation application of International Application PCT/JP2020/009946, filed on Mar. 9, 2020; the entire contents of which are incorporated herein by reference.

FIELD

Embodiments described herein relate generally to a coating head, a coating apparatus, and a coating method.

BACKGROUND

There is a coating head that coats a liquid by using a coating bar. A coating apparatus that can form a uniform coated film is desirable.

DETAILED DESCRIPTION

Figure 1A:
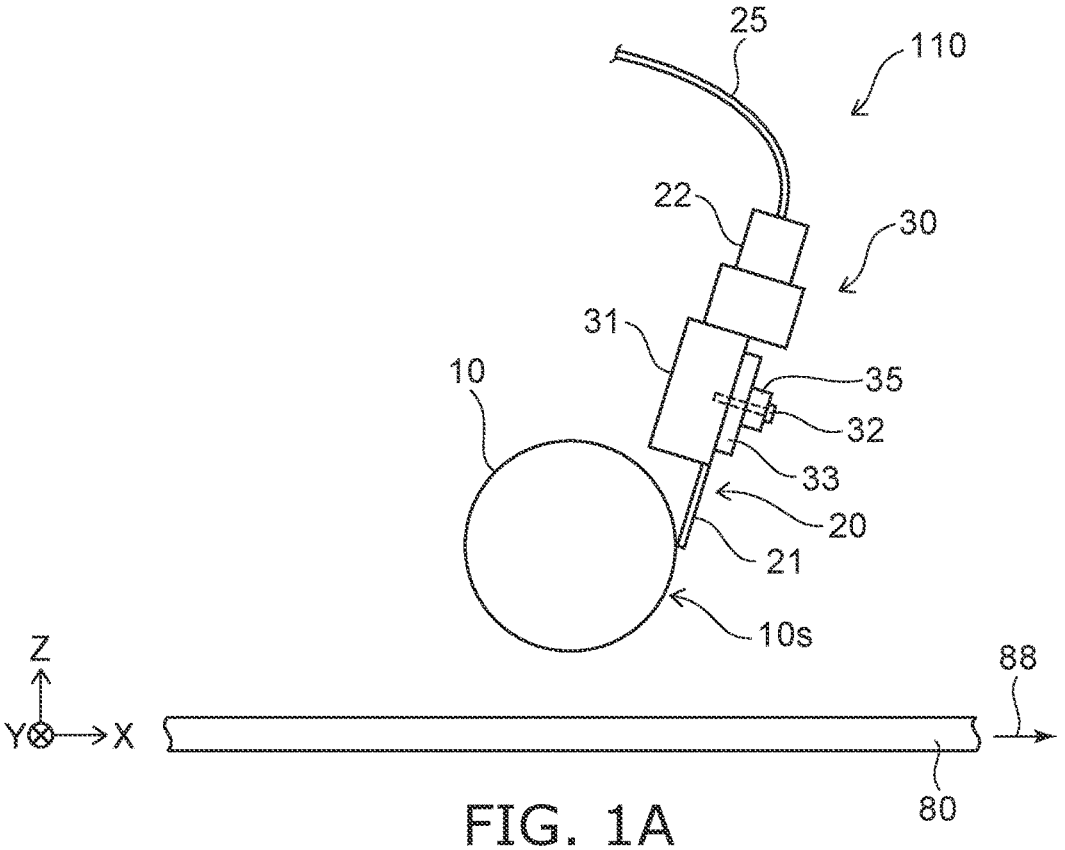
FIGS. 1A and 1B are schematic side views illustrating a portion of a coating head according to a first embodiment.

According to one embodiment, a coating head includes a coating bar, a plurality of nozzles, a first member, a plurality of second members, a plurality of third members, a plurality of elastic members, and a position controller. The coating bar is configured to face a coating member. The nozzles are configured to supply a liquid toward the coating bar. The first member includes a plurality of first recesses. At least a portion of one of the nozzles is between one of the first recesses and one of the third members. The at least a portion of the one of the nozzles and the one of the third members are fixed to the first member by one of the second members. One of the elastic members is located in at least one of a first position, a second position, or a third position. The first position is between the one of the third members and the one of the second members. The second position is between the at least a portion of the one of the first recesses and the one of the nozzles. The third position is between the at least a portion of the one of the nozzles and the one of the third members. The position controller controls a relative position between the coating bar and the nozzles.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with like reference numerals, and a detailed description is omitted as appropriate.

First Embodiment

Figure 1B:
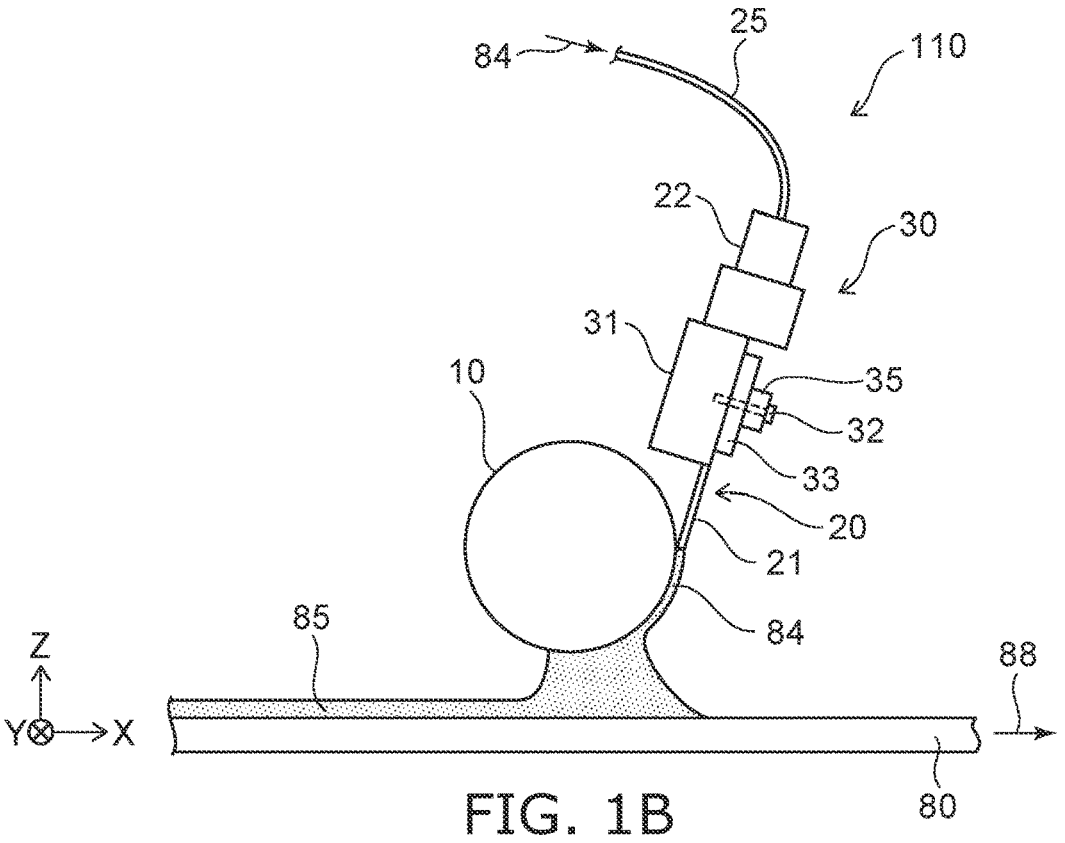

FIGS. 1A and 1B are schematic side views illustrating a portion of a coating head according to a first embodiment.

Figure 2A:
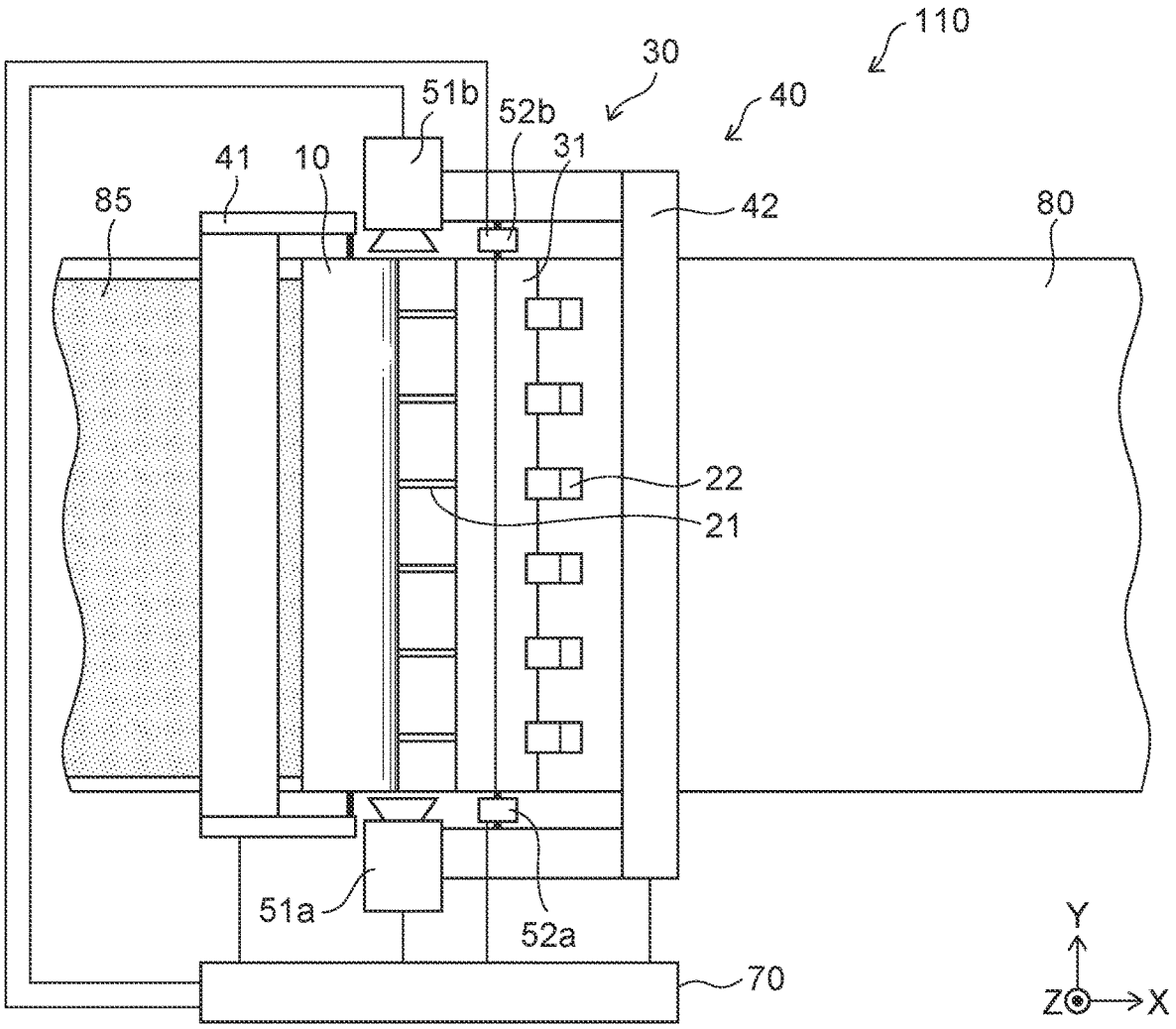
FIGS. 2A and 2B are schematic views illustrating the coating head according to the first embodiment.
Figure 2B:
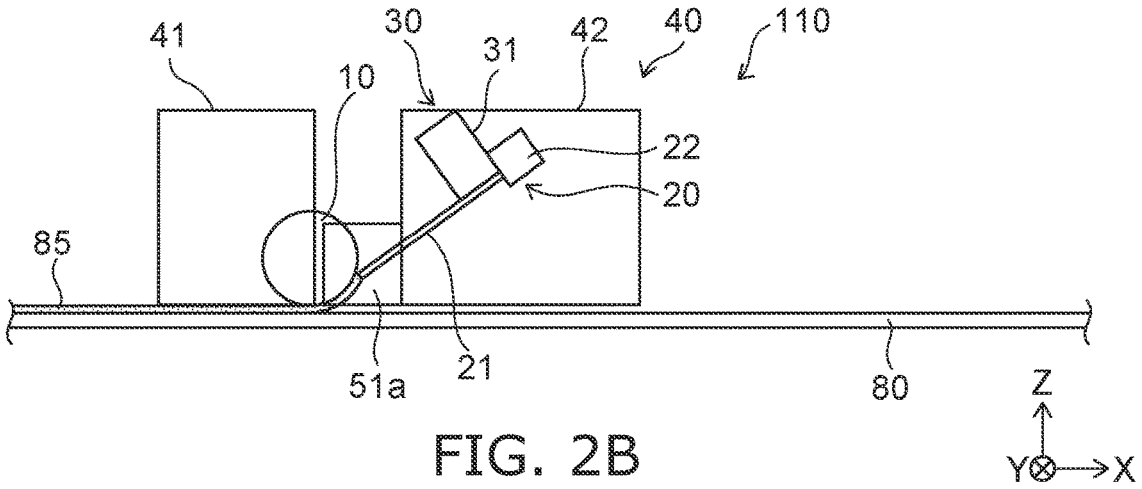

FIGS. 2A and 2B are schematic views illustrating the coating head according to the first embodiment. FIG. 2A is a top view. FIG. 2B is a side view. In FIG. 2B, some of the components are not illustrated for easier viewing of the drawing.

Figure 3:
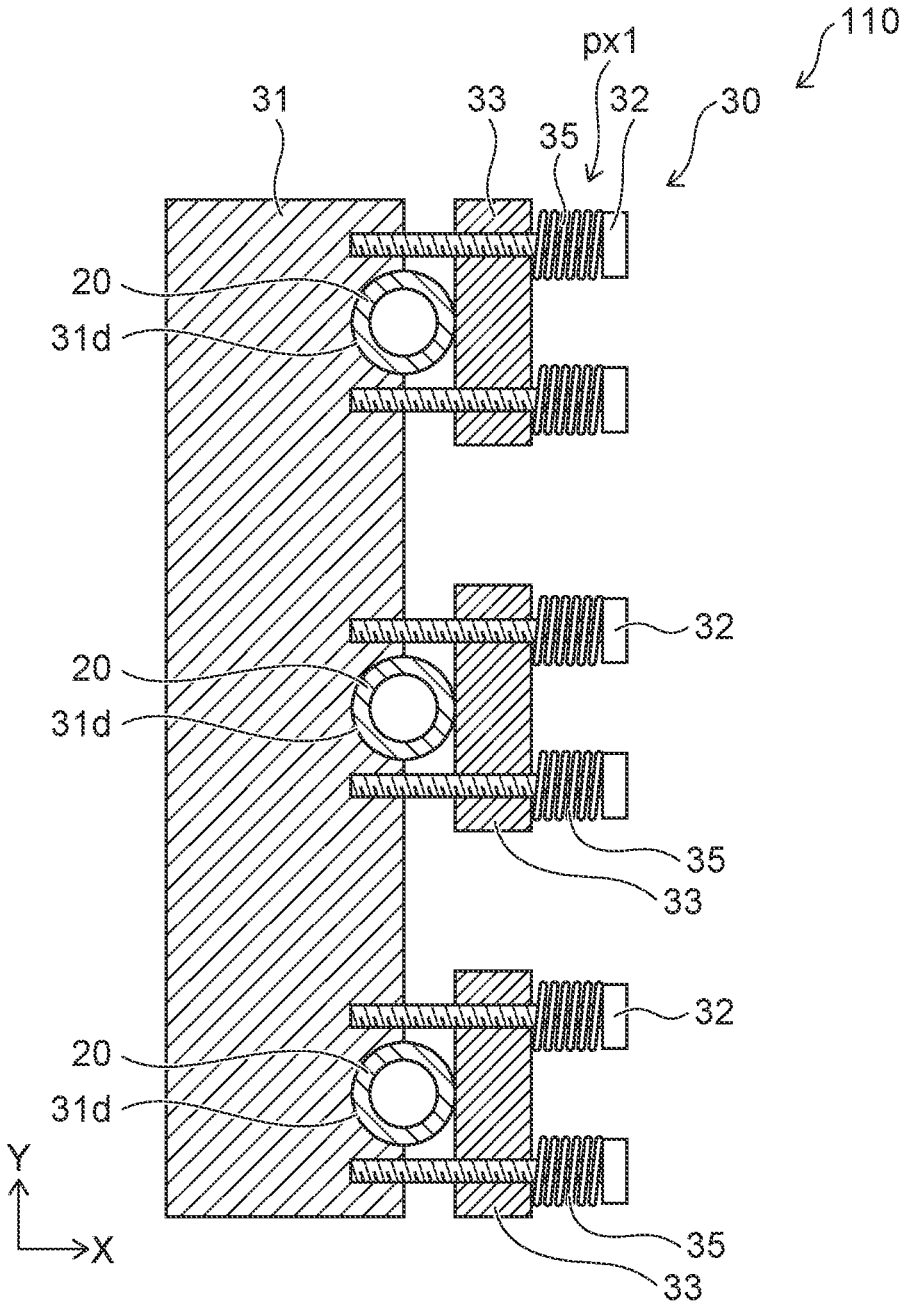
FIG. 3 is a schematic view illustrating the coating head according to the first embodiment.

FIG. 3 is a schematic view illustrating the coating head according to the first embodiment. FIG. 3 is a top view of a portion of the coating head.

Figure 4:
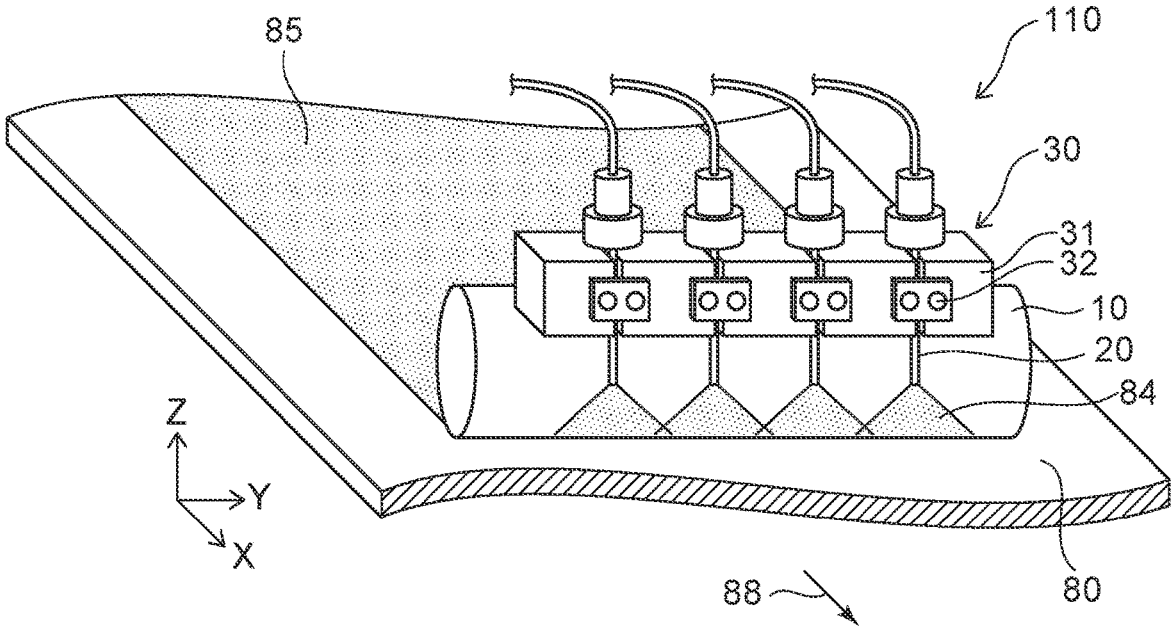
FIG. 4 is a schematic perspective view illustrating a portion of the coating head according to the first embodiment.

FIG. 4 is a schematic perspective view illustrating a portion of the coating head according to the first embodiment.

As shown in FIGS. 1A, 2A, and 3, the coating head 110 according to the embodiment includes a coating bar 10, multiple nozzles 20 (referring to FIG. 3), a first member 31, multiple second members 32 (referring to FIG. 3), multiple third members 33 (referring to FIG. 3), multiple elastic members 35 (referring to FIG. 3), and a position controller 40 (referring to FIG. 2A). The multiple nozzles 20, the first member 31, the multiple second members 32, and the multiple third members 33 are included in a head part 30 (referring to FIG. 1A).

As shown in FIG. 1A, the coating bar 10 is configured to face a coating member 80.

As shown in FIG. 1B, the multiple nozzles 20 are configured to supply a liquid 84 toward the coating bar 10. The multiple nozzles 20 are, for example, needle nozzles. FIG. 1A corresponds to a state in which the liquid 84 is not supplied. FIG. 1B corresponds to a state in which the liquid 84 is being supplied. As shown in FIG. 1A, a gap is provided between the coating bar 10 and the coating member 80. As shown in FIG. 1B, a meniscus is formed between the coating bar 10 and the coating member 80 when the liquid 84 is supplied to the coating bar 10. Thus, the coating bar 10 is configured to form a meniscus of the liquid 84 between the coating bar 10 and the coating member 80. A coated film 85 is formed of the liquid 84 coated onto the coating member 80. The target film is obtained by solidifying the coated film 85.

As shown in FIG. 1A, the direction from the coating member 80 toward the coating bar 10 is taken as a Z-axis direction. One direction perpendicular to the Z-axis direction is taken as an X-axis direction. A direction perpendicular to the Z-axis direction and the X-axis direction is taken as a Y-axis direction.

As shown in FIG. 1A, the coating member 80 moves relative to the coating bar 10 along a movement direction 88. For example, the movement direction 88 is along the X-axis direction.

As shown in FIG. 4, the coating bar 10 extends in the Y-axis direction. In one example, the coating bar 10 is cylindrical.

In one example as shown in FIG. 1A, the multiple nozzles 20 extend in a direction that is oblique to the Z-axis direction and is toward the coating bar 10.

In the example as shown in FIG. 1A, one of the multiple nozzles 20 includes a nozzle portion 21 and a base part 22. In the example, the nozzle portion 21 is between one of multiple first recesses 31*d* and one of the multiple third members 33. The base part 22 is not between the one of the multiple first recesses 31*d* and the one of the multiple third members 33. For example, the base part 22 is located above the first member 31. As described below, for example, the nozzle portion 21 may be detachable from the base part 22. For example, a supply pipe 25 is connected to the base part 22. As shown in FIG. 1B, the liquid 84 is supplied to the base part 22 via the supply pipe 25. The liquid 84 is dispensed from the nozzle portion 21.

FIG. 3 illustrates the head part 30. As shown in FIG. 3, the first member 31 includes the multiple first recesses 31*d*. As shown in FIG. 3, at least a portion of one of the multiple nozzles 20 is between one of the multiple first recesses 31*d* and one of the multiple third members 33. For example, at least a portion of the one of the multiple nozzles 20 recited above is the nozzle portion 21. The at least a portion of the one of the multiple nozzles 20 (e.g., the nozzle portion 21) and the one of the multiple third members 33 are fixed to the first member 31 by one of the multiple second members 32.

The first member 31 is a base to which the multiple nozzles 20 are mounted. The multiple second members 32 are, for example, fixing members such as screws, etc. Holes, etc., that engage with the fixing members such as the screws, etc., are provided in the first member 31. For example, holes through which the fixing members such as the screws, etc., pass are provided in the multiple third members 33. The fixing members such as the screws, etc., pass through the holes of the multiple third members (the fixing members) and are fixed to the first member 31. One of the multiple nozzles 20 is located between the first member 31 and one of the multiple third members 33. The one of the multiple nozzles 20 is fixed to the first member 31 by being clamped between the first member 31 and the one of the multiple third members 33. The multiple third members 33 are pressing members.

In the example shown in FIG. 3, one of the multiple elastic members 35 is located at a first position px1. The first position px1 is between the one of the multiple third members 33 and the one of the multiple second members 32.

As shown in FIG. 2A, the position controller 40 controls the relative position between the coating bar 10 and the multiple nozzles 20. In the example, the position controller 40 includes a first holder 41 and a second holder 42; the first holder 41 holds the coating bar 10. The second holder 42 holds the multiple nozzles 20. For example, the second holder 42 holds the multiple nozzles 20 by holding the first member 31.

The relative position between the coating bar 10 and the multiple nozzles 20 can be controlled by controlling the relative position of the first holder 41 and the second holder 42.

According to the embodiment, the liquid 84 is supplied from the multiple nozzles 20 toward the coating bar 10. Thereby, the meniscus can be uniformly spread in a wide area. The multiple nozzles 20 are stably fixed at positions guided by the multiple first recesses 31*d*. The positions of the tips of the multiple nozzles 20 are easily aligned thereby. Because the multiple nozzles 20 are fixed to the positions guided by the multiple first recesses 31*d*, the pitch of the multiple nozzles 20 can be set to the desired state. By the fixation using the elastic member 35, fluctuation of the coating state due to vibration of the coating bar 10, etc., can be suppressed. For example, even when a supply pump of the liquid 84 has a pulsatory motion, the elastic member 35 easily reduces the effects of the pulsatory motion.

By providing the multiple elastic members 35 according to the embodiment, a moderate force is applied to the multiple third members 33. The multiple nozzles 20 are held by a moderate force due to the first member 31 and the multiple third members 33. For example, the multiple nozzles 20 can be fixed with a moderate tolerance. The amount of the liquid 84 that is dispensed from the multiple nozzles 20 and adhered to the coating bar 10 can be appropriately maintained thereby. Thereby, a uniform coated film 85 can be formed on the coating member 80. According to the embodiment, a coating head can be provided in which a uniform coated film 85 can be formed. For example, the uniformity of the thickness of the coated film 85 is high.

The position controller 40 includes, for example, an actuator. At least one of the first holder 41 or the second holder 42 may include an actuator. For example, the relative positional relationship between the coating bar 10 and the multiple nozzles 20 can be favorably set. The first holder 41 may include, for example, a 1-axis actuator (e.g., a Z-actuator). The second holder 42 may include, for example, a multi-axis actuator (e.g., an XZθ-actuator).

As shown in FIG. 2A, the coating head 110 may include first sensors 51*a* and 51*b*. For example, the first sensors 51*a* and 51*b* detect the distance between the coating bar 10 and the coating member 80.

As shown in FIG. 2A, the coating head 110 may include a controller 70. For example, the controller 70 acquires the detection result of the first sensors 51*a* and 51*b* and controls the position controller 40 (e.g., the first holder 41) based on the detection result. The distance between the coating bar 10 and the coating member 80 is appropriately controlled by the controller 70. The first sensors 51*a* and 51*b* include, for example, optical elements. The first sensors 51*a* and 51*b* may include, for example, cameras.

As shown in FIG. 2A, the coating head 110 may include second sensors 52*a* and 52*b*. The second sensors 52*a* and 52*b* detect the stress between the coating bar 10 and the multiple nozzles 20. For example, the controller 70 acquires the detection result of the second sensors 52*a* and 52*b* and controls the position controller 40 (e.g., the second holder 42) based on the detection result. The relative position of the coating bar 10 and the multiple nozzles 20 is appropriately controlled by the controller 70.

As described below, other than the first position px1, the multiple elastic members 35 may be located at a second position or a third position. Examples of these positions are described below.

The elastic member 35 includes, for example, a spring. The spring includes at least one of a coil spring, a leaf spring, or a disk spring. The elastic member 35 may include a resin such as rubber, etc. When the elastic member 35 includes a spring, the force is easily controlled favorably. When the elastic member 35 includes a coil spring, the force is easily controlled more favorably. When the third member 33 has a lower elastic modulus than the material of the nozzle 20, the elastic member 35 can be omitted, or the elastic modulus of the elastic member 35 can be made smaller.

As shown in FIG. 1A, for example, the multiple nozzles 20 contact the coating bar 10. The positions of the multiple nozzles 20 with respect to the coating bar 10 are stabilized thereby. A stable supply of the liquid 84 is possible. Because the multiple nozzles 20 contact the coating bar 10, the uniformity of the coated film 85 is high compared to when the multiple nozzles 20 do not contact the coating bar 10.

For example, the state in which the multiple nozzles 20 contact the coating bar 10 and the state in which the multiple nozzles 20 are separated from the coating bar 10 may be formable by the position controller 40 (e.g., at least one of the first holder 41 or the second holder 42). The multiple nozzles 20 and the coating bar 10 can move relatively in the X-axis direction.

At least one of the first holder 41 or the second holder 42 may be configured to apply, to at least one of the coating bar 10 or the multiple nozzles 20, stress that has at least one of the orientation from the coating bar 10 toward the multiple nozzles 20 or the orientation from the multiple nozzles 20 toward the coating bar 10.

Figure 5A:
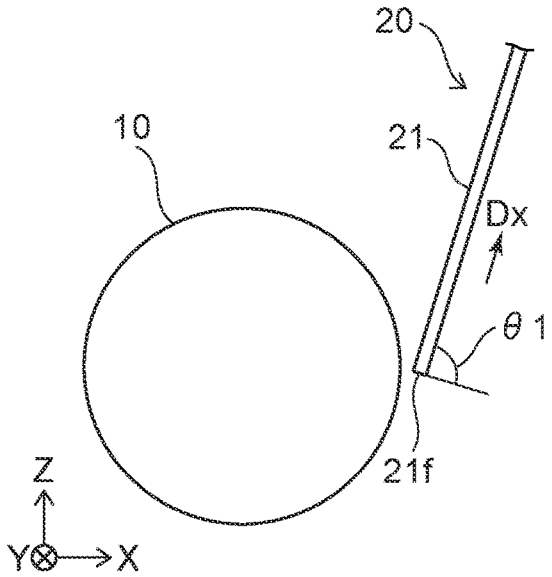
FIGS. 5A and 5B are schematic side views illustrating a portion of the coating head according to the first embodiment.
Figure 5B:
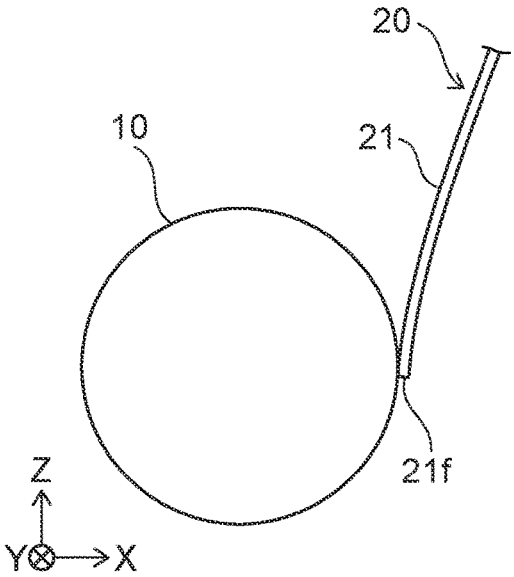

FIGS. 5A and 5B are schematic side views illustrating a portion of the coating head according to the first embodiment.

FIG. 5A shows a state in which the multiple nozzles 20 are separated from the coating bar 10. FIG. 5B shows a state in which the multiple nozzles 20 contact the coating bar 10. For example, stress that is generated by at least one of the first holder 41 or the second holder 42 is applied to at least one of the coating bar 10 or the multiple nozzles 20. As shown in FIG. 5B, at least one of the multiple nozzles 20 may reversibly bend according to the stress. The multiple nozzles 20 may have moderate flexibility. The multiple nozzles 20 may be able to deflect.

As shown in FIG. 5A, each (one) of the multiple nozzles 20 includes an end surface 21*f* in the state in which the multiple nozzles 20 are separated from the coating bar 10. The liquid 84 is dispensed from the end surface 21*f*. It is favorable for an angle θ1 between the end surface 21*f* and an extension direction Dx in which each (one) of the multiple nozzles 20 extends to be, for example, about 90 degrees. According to the embodiment, the angle θ1 is, for example, not less than 80 degrees and not more than 100 degrees. By such an angle, for example, the contact state between the coating bar 10 and the tip of the nozzle 20 does not easily change even when the fixed state of the nozzle 20 (e.g., a rotational position having the extension direction Dx as the axis) changes. A stable coating is more possible. By such an angle, damage of the coating bar 10 can be suppressed.

In one example, the length of the nozzle 20 is, for example, not less than 2 cm and not more than 10 cm. The length of the nozzle 20 may be, for example, not less than 3 cm and not more than 6 cm. In one example, the inner diameter of the nozzle 20 is not less than 0.15 mm and not more than 2 mm. By setting the inner diameter to be not less than 0.15 mm, the pump pressure that is necessary for supplying the liquid 84 to the nozzle 20 is relaxed. By setting the inner diameter to be not more than 2 mm, the pulsatory motion of the liquid 84 is easily suppressed. A more uniform coated film is easily obtained thereby.

Figure 6:
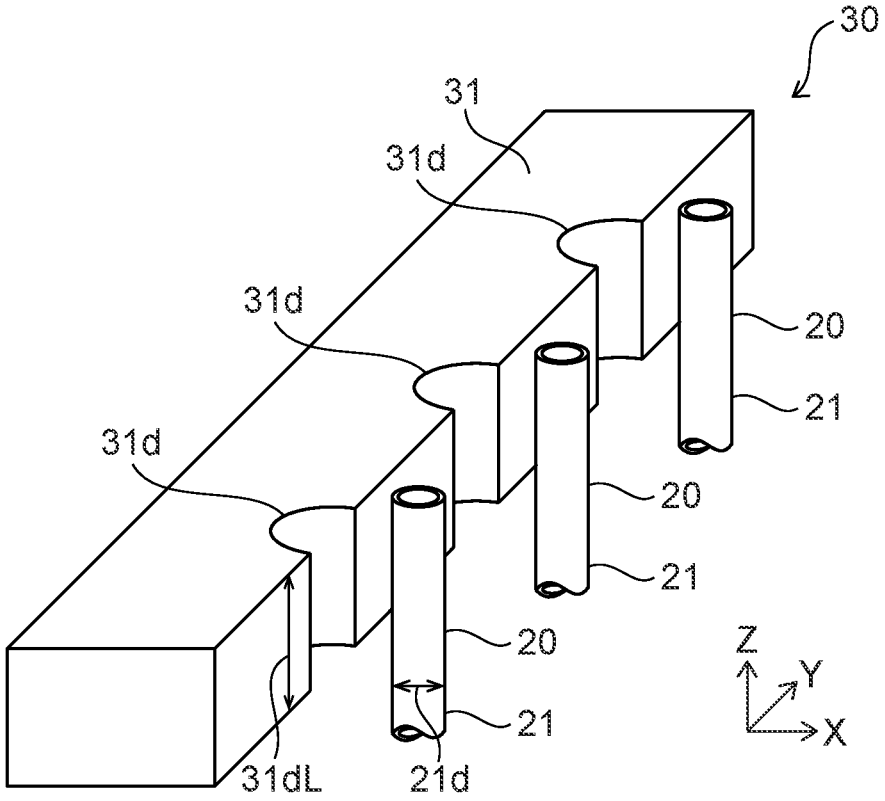
FIG. 6 is a schematic perspective view illustrating a portion of the coating head according to the first embodiment.

FIG. 6 is a schematic perspective view illustrating a portion of the coating head according to the first embodiment.

FIG. 6 illustrates the first member 31 and the multiple nozzles 20. In FIG. 6, the first member 31 and the multiple nozzles 20 are drawn as being separated from each other for easier viewing of the drawing.

As shown in FIG. 6, the multiple first recesses 31*d* are provided in the first member 31. Each (one) of the multiple first recesses 31*d* extends along the direction in which at least a portion of each (one) of the multiple nozzles 20 (e.g., the nozzle portion 21) extends. At least a portion of the nozzle portion 21 engages such a first recess 31*d*. The position of the nozzle portion 21 is stabilized.

As shown in FIG. 6, at least a portion of each (one) of the multiple first recesses 31*d* may be curved. For example, the cross-sectional shape of the first recess 31*d* is "U-shaped". According to the embodiment, the cross-sectional shape of the first recess 31*d* may be "V-shaped". The cross-sectional shape may be rectangular. When the cross-sectional shape of the first recess 31*d* is "U-shaped", the force that is applied to the nozzle portion 21 is easily made uniform. For example, damage of the nozzle portion 21 can be suppressed.

According to the embodiment, when the cross-sectional shape of the first recess 31*d* is curved, the curvature radius of the cross-sectional shape of the first recess 31*d* is, for example, not less than the curvature radius of the cross-sectional shape of the outer surface of the nozzle portion 21.

At least a portion of the nozzle portion 21 enters the first recess 31*d*. In one example, another portion of the nozzle portion 21 is outside the first recess 31*d*. In one example, the length of the portion of the nozzle portion 21 that is outside the first recess 31*d* is not less than ⅓ and not more than ⅔ of the outer diameter of the nozzle portion 21. An outer diameter 21*d* of the nozzle portion 21 is, for example, not less than 0.4 mm and not more than 3 mm. A length 31dL of the first recess 31*d* (referring to FIG. 6) is, for example, not less than 1 cm and not more than 3 cm.

Figure 7:
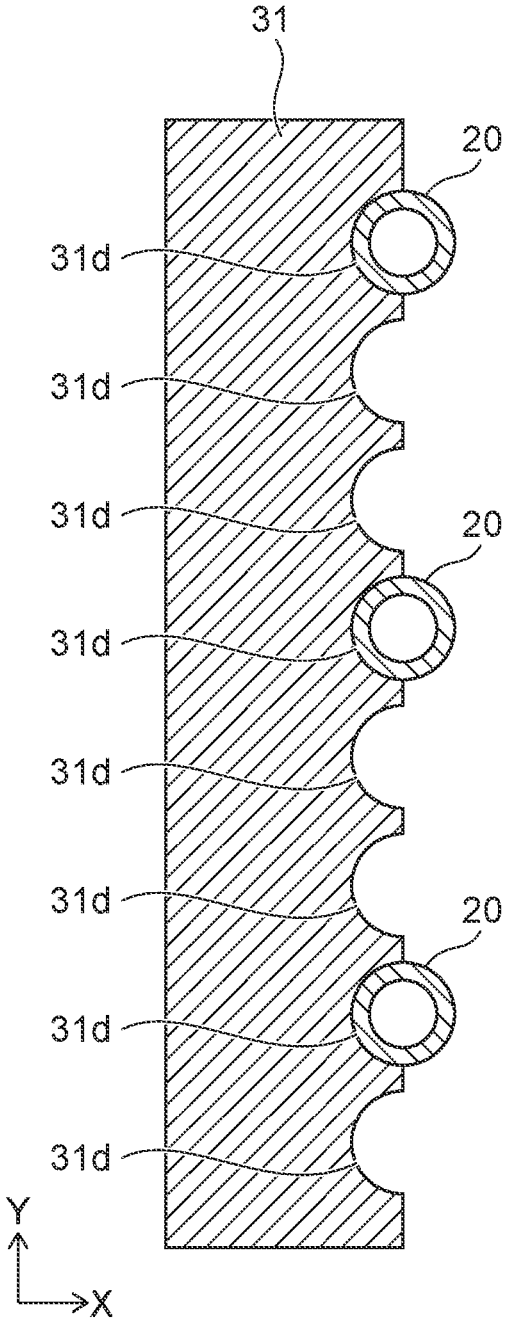
FIG. 7 is a schematic view illustrating the coating head according to the first embodiment.

FIG. 7 is a schematic view illustrating the coating head according to the first embodiment.

FIG. 7 is a top view of a portion of the coating head. The second member 32, the third member 33, and the elastic member 35 are not illustrated in FIG. 7.

As shown in FIG. 7, the multiple nozzles 20 may be provided in a portion of the multiple first recesses 31*d*. In the example of FIG. 7, for example, the pitch of the multiple nozzles 20 is greater than the pitch of the multiple first recesses 31*d*. The nozzle 20 is not provided at some of the multiple first recesses 31*d*. For example, the pitch of the multiple nozzles 20 may be able to be modified according to the characteristics of the liquid 84. For example, the pitch of the multiple nozzles 20 can be easily modified by providing the multiple first recesses 31*d* at a small pitch and by providing the multiple nozzles 20 at a portion of the multiple first recesses 31*d*.

According to the embodiment, the cross-sectional shape of the coating bar 10 is arbitrary. The cross-sectional shape of the coating bar is, for example, circular, flattened circular, or polygonal. A portion of the cross-sectional shape may be curvilinear; and another portion may be linear. For example, the cross-sectional shape of the surface of the coating bar 10 facing the coating member 80 may be curvilinear.

As shown in FIG. 1A, a surface 10*s* (e.g., the side surface) of the coating bar 10 contacts the multiple nozzles 20. As shown in FIG. 1A, the surface 10*s* may be a curved surface. According to the embodiment, the surface 10*s* may be a plane. When the surface 10*s* is a plane, for example, the contact state between the coating bar 10 and the multiple nozzles 20 is easily made uniform.

The coating bar 10 includes, for example, at least one selected from the group consisting of stainless steel, aluminum, titanium, and glass. It is more favorable for the coating bar 10 to include stainless steel or aluminum. Thereby, the processing of the coating bar 10 is easier. In one example, the surface of the coating bar 10 is a mirror surface. The surface of the coating bar 10 may include a fine unevenness. When a fine unevenness is provided, for example, a high wettability with the liquid 84 is obtained. A maximum height Rz of the unevenness is, for example, not less than 5 μm and not more than 50 μm. An arithmetic average surface roughness Ra of the unevenness is, for example, not less than 1 μm and not more than 10 μm. For example, the unevenness is made by sandblasting.

Figure 8:
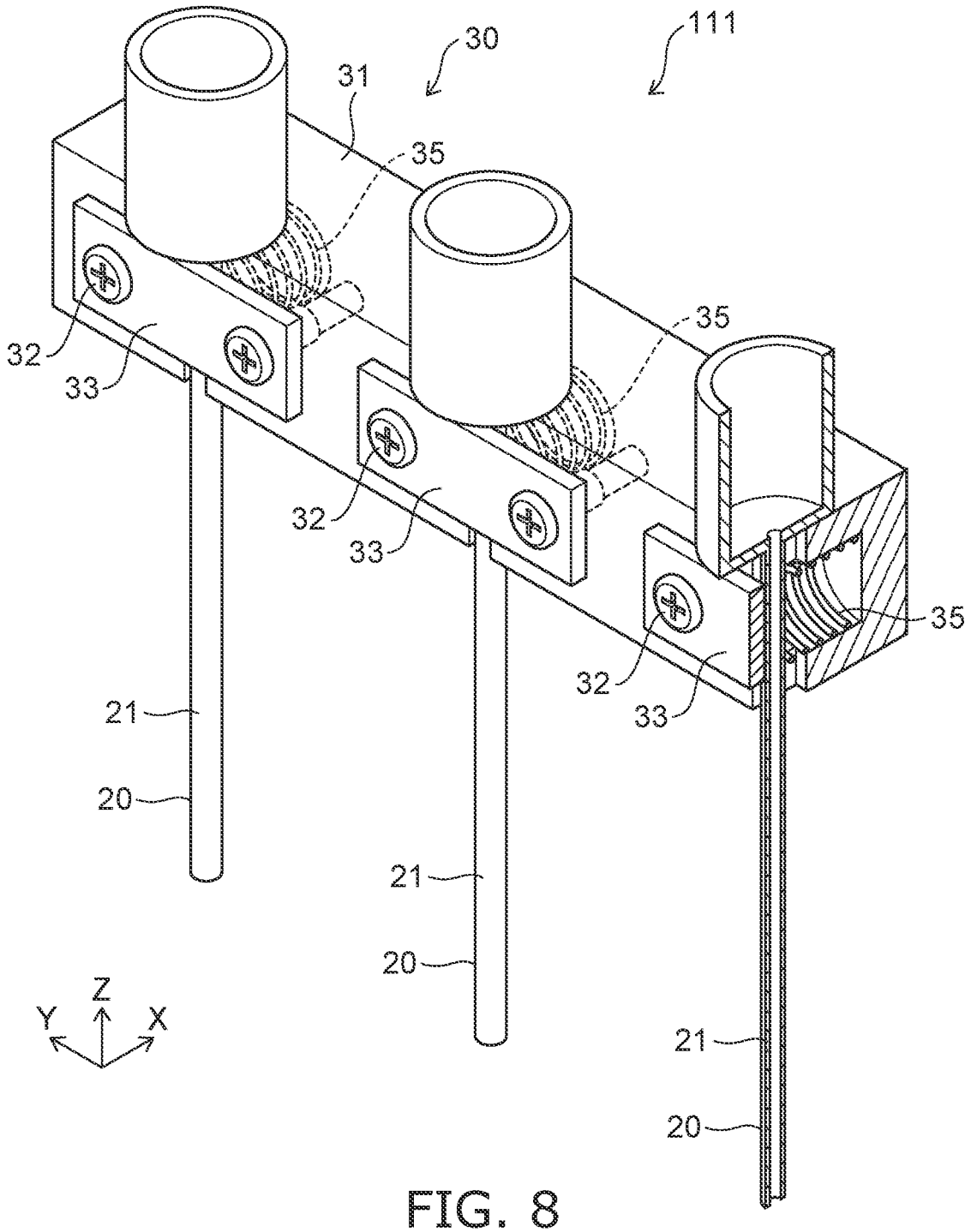
FIG. 8 is a schematic perspective view illustrating a portion of a coating head according to the first embodiment.

FIG. 8 is a schematic perspective view illustrating a portion of a coating head according to the first embodiment.

Figure 9:
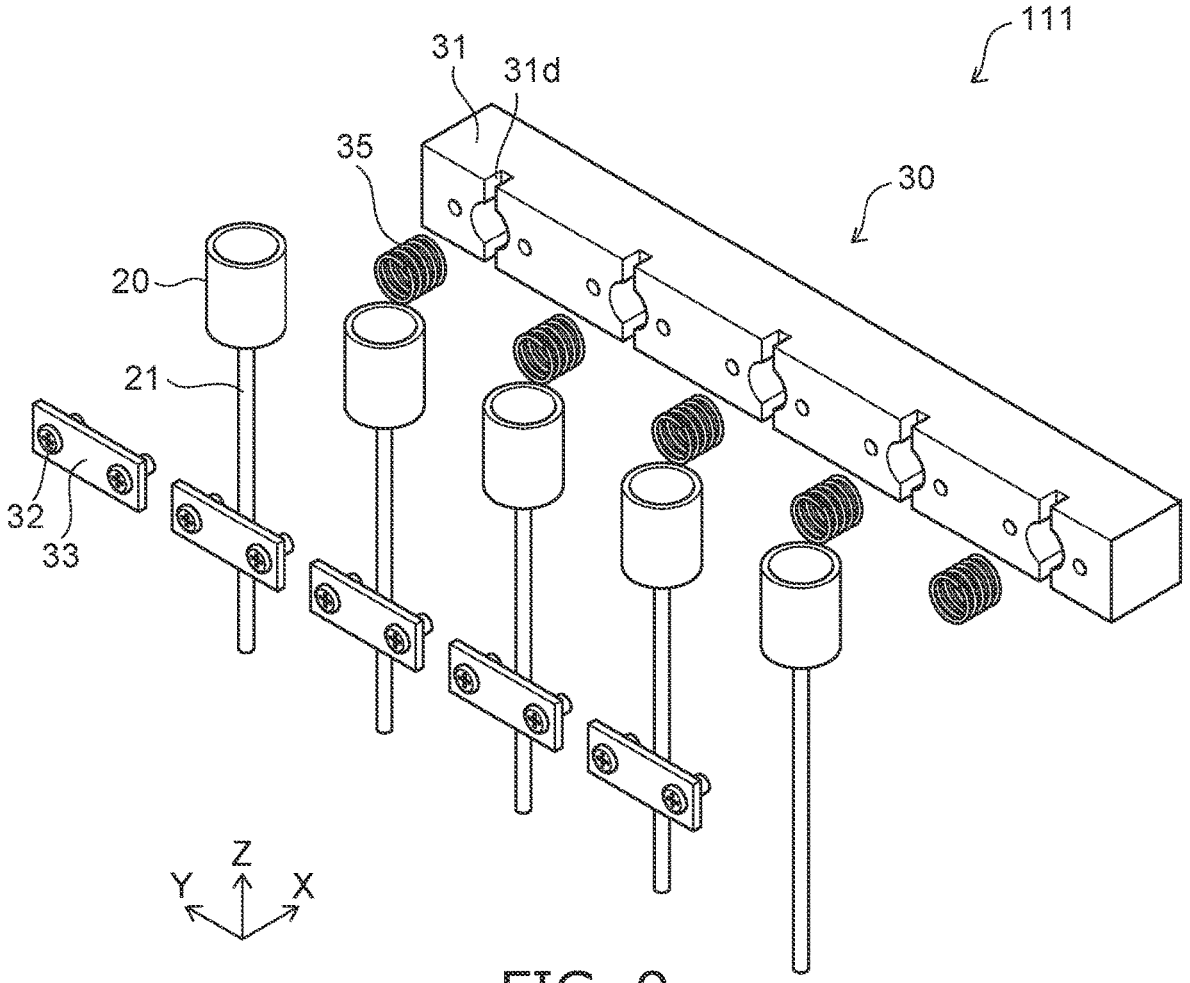
FIG. 9 is a schematic exploded perspective view illustrating a portion of the coating head according to the first embodiment.

FIG. 9 is a schematic exploded perspective view illustrating a portion of the coating head according to the first embodiment.

Figure 10:
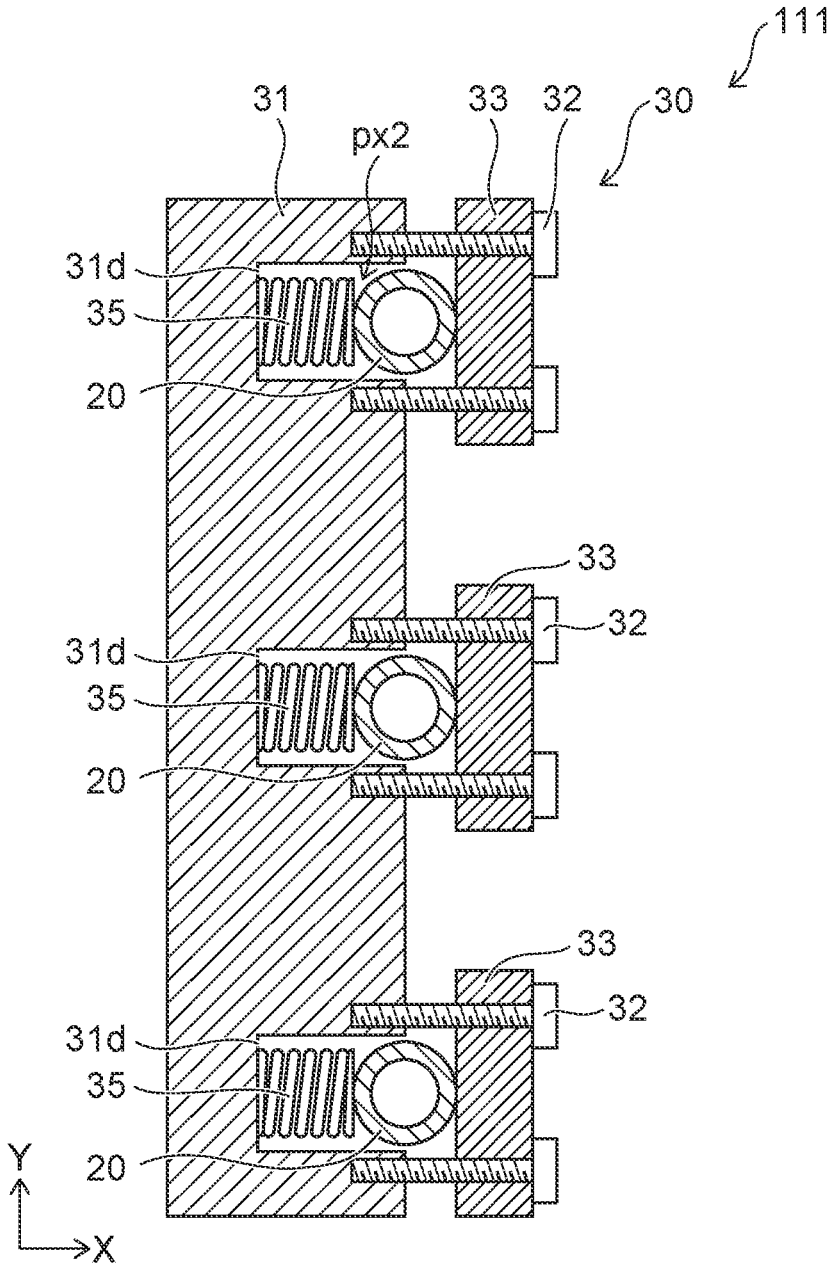
FIG. 10 is a schematic view illustrating a portion of the coating head according to the first embodiment.

FIG. 10 is a schematic view illustrating a portion of the coating head according to the first embodiment.

FIG. 10 is a top view of a portion of the coating head.

FIGS. 8 to 10 illustrate the head part 30 of the coating head 111 according to the embodiment. Other than the head part 30, the configuration of the coating head 111 may be similar to that of the coating head 110. An example of the head part 30 of the coating head 111 will now be described.

As shown in FIGS. 8 to 10, the head part 30 includes the multiple nozzles 20, the first member 31, the multiple second members 32, the multiple third members 33, and the multiple elastic members 35. The first member 31 includes the multiple first recesses 31*d*. At least a portion of one of the multiple nozzles 20 is between one of the multiple first recesses 31*d* and one of the multiple third members 33. The at least a portion of the one of the multiple nozzles 20 recited above and the one of the multiple third members 33 recited above are fixed to the first member 31 by one of the multiple second members 32.

One of the multiple elastic members 35 is located at a second position px2 (referring to FIG. 10). The second position px2 is between the at least a portion of the one of the multiple first recesses 31*d* recited above and the one of the multiple nozzles 20 recited above.

In the coating head 111 that includes such a head part 30 as well, a coating head can be provided in which a uniform coated film 85 can be formed.

Figure 11:
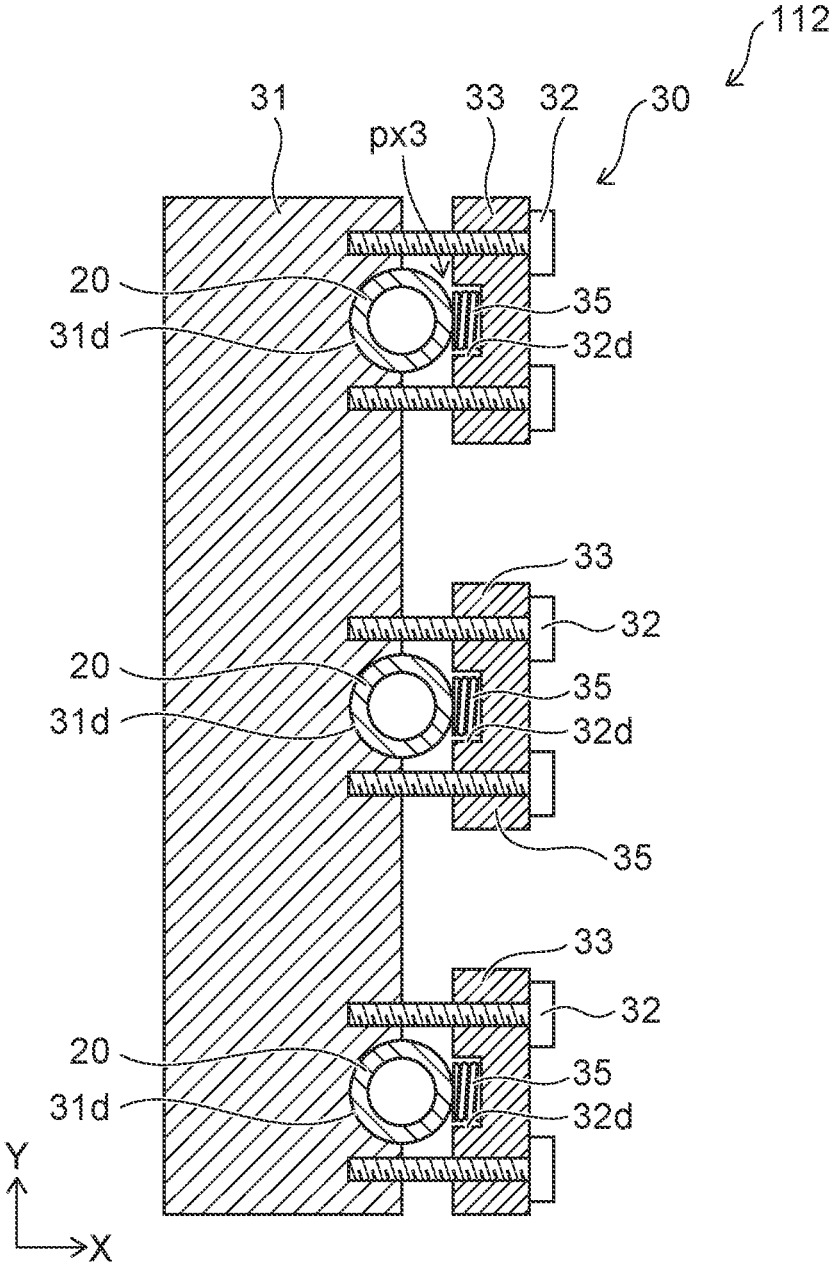
FIG. 11 is a schematic view illustrating a portion of a coating head according to the first embodiment.

FIG. 11 is a schematic view illustrating a portion of a coating head according to the first embodiment.

FIG. 11 is a top view of a portion of the coating head.

FIG. 11 illustrates the head part 30 of the coating head 112 according to the embodiment. Other than the head part 30, the configuration of the coating head 112 may be similar to the coating head 110. An example of the head part 30 of the coating head 112 will now be described.

In the coating head 112 as well, the head part 30 includes the multiple nozzles 20, the first member 31, the multiple second members 32, the multiple third members 33, and the multiple elastic members 35. The first member 31 includes the multiple first recesses 31*d*. In the coating head 112, one of the multiple elastic members 35 is located at a third position px3. The third position px3 is between at least a portion of one of the multiple nozzles 20 and one of the multiple third members 33.

In the coating head 112 that includes such a head part 30 as well, a coating head can be provided in which a uniform coated film 85 can be formed.

In the example, one of the multiple third members 33 includes a second recess 32*d*. At least a portion of one of the multiple nozzles 20 is between the second recess 32*d* and one of the multiple first recesses 31*d*. By providing the second recess 32*d*, the precision of the positions of the multiple nozzles 20 can be further increased.

According to the embodiment, the elastic member 35 may be located in at least one of the first position px1 recited above, the second position px2 recited above, or the third position px3 recited above.

Figure 12:
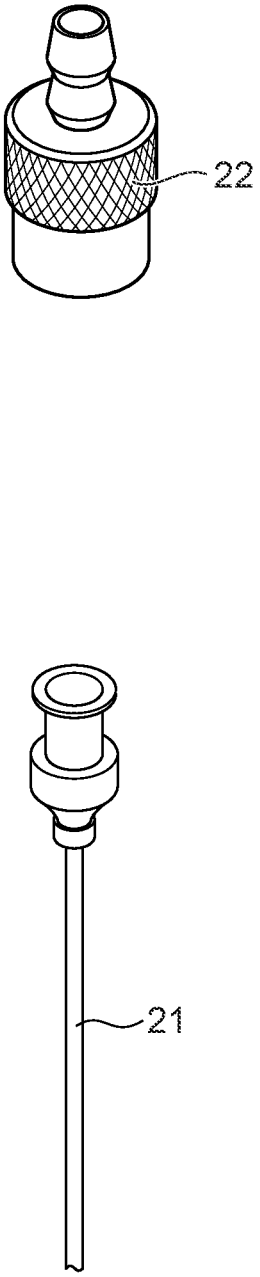
FIG. 12 is a schematic view illustrating a portion of the coating head according to the first embodiment.

FIG. 12 is a schematic view illustrating a portion of the coating head according to the first embodiment.

As shown in FIG. 12, one of the multiple nozzles 20 includes the nozzle portion 21 and the base part 22. In the example, the nozzle portion 21 and the base part 22 are detachable. Thereby, for example, cleaning of the nozzle portion 21 and the base part 22 is easier. For example, replacement of at least one of the nozzle portion 21 or the base part 22 is easier. For example, the bottom portion of the base part 22 is located at the upper portion of the first member 31. The tips of the multiple nozzles 20 are easily aligned thereby.

Second Embodiment

A second embodiment relates to a coating apparatus.

Figure 13:
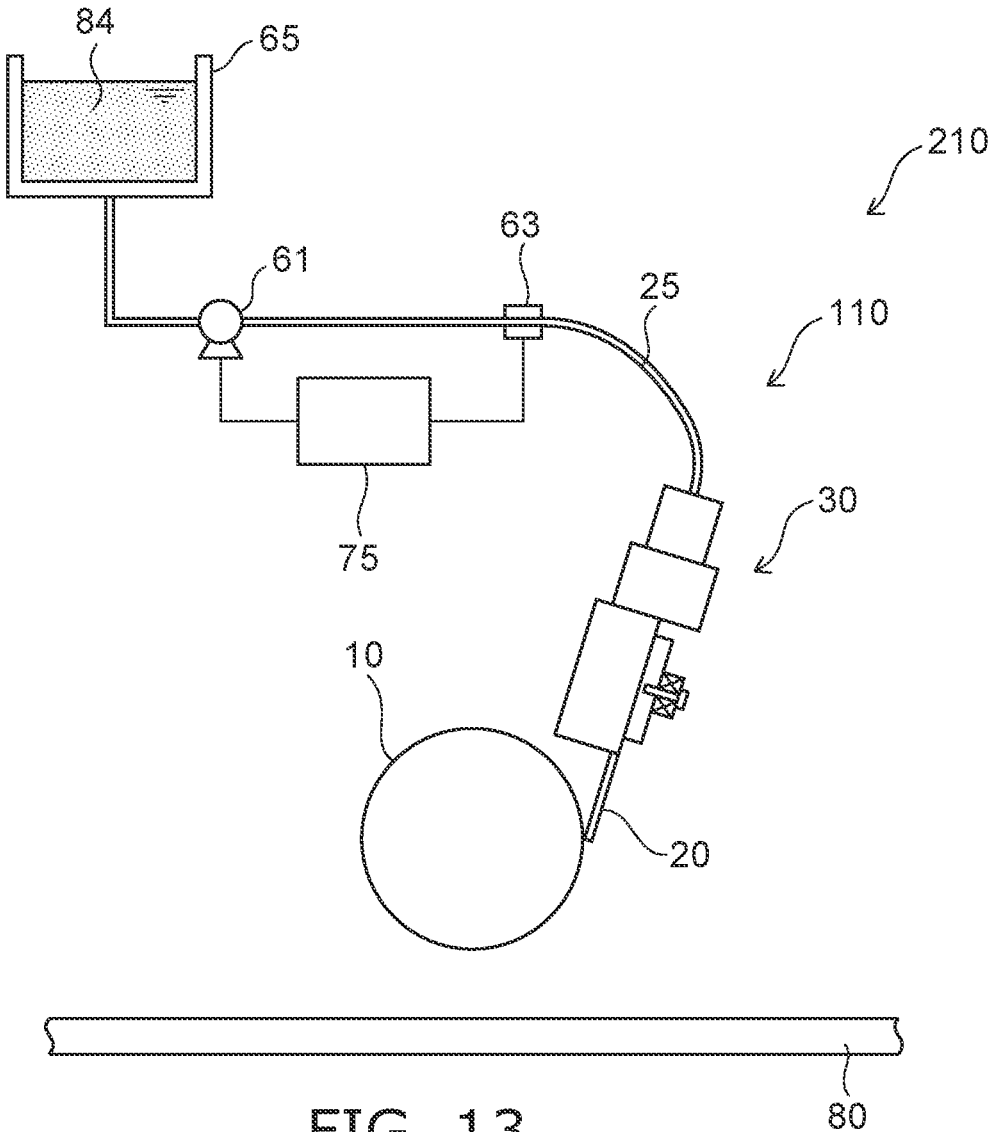
FIG. 13 is a schematic view illustrating a coating apparatus according to a second embodiment.

FIG. 13 is a schematic view illustrating the coating apparatus according to the second embodiment.

As shown in FIG. 13, the coating apparatus 210 according to the embodiment includes the coating head according to the first embodiment (in the example, the coating head 110) and a supplier 61. The supplier 61 supplies the liquid 84 to the multiple nozzles 20. The supplier 61 includes, for example, a pump. In the example, a tank 65 in which the liquid 84 is stored is provided. The supplier 61 is connected with the tank 65. The supplier 61 is connected with the nozzle 20 by the supply pipe 25. The liquid 84 is supplied from the supplier 61 to the nozzle 20; and the liquid 84 is supplied from the nozzle 20 toward the coating bar 10. The coating head that is included in the coating apparatus 210 may be any coating head according to the first embodiment.

A liquid sensor 63 may be provided as shown in FIG. 13. The liquid sensor 63 detects the supply rate of the liquid 84 toward the multiple nozzles 20. For example, the liquid sensor 63 measures the flow rate of the liquid 84 by utilizing the Doppler effect.

A supply controller 75 may be provided. The supply controller 75 controls the supplier 61 based on the supply rate detected by the liquid sensor 63. A more uniform coated film is easily obtained thereby.

Figure 14:
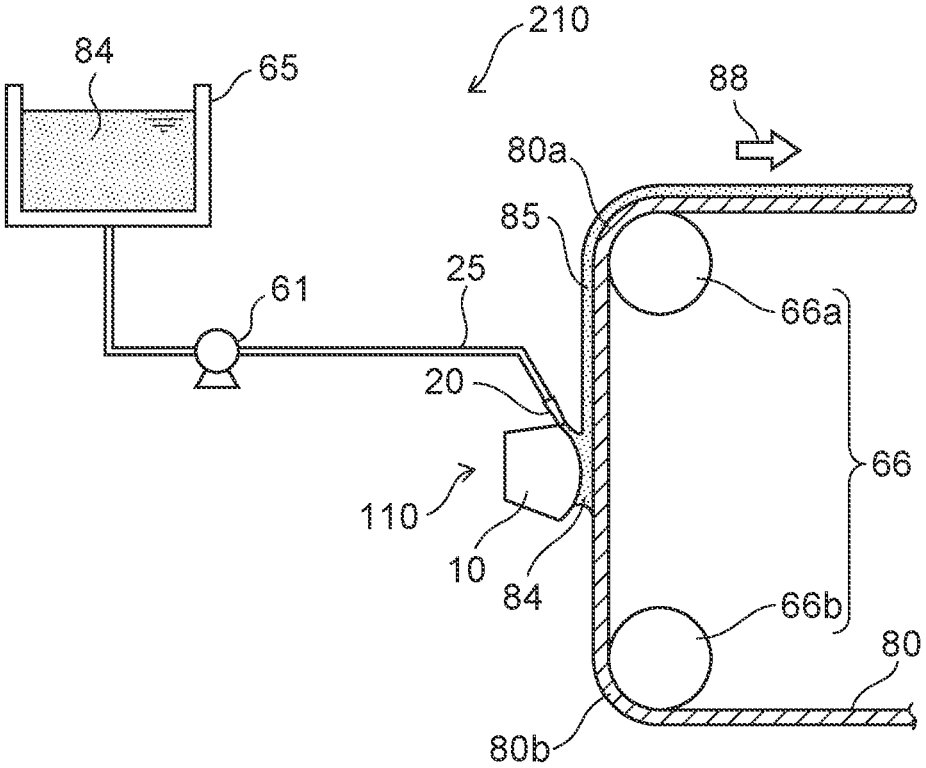
FIG. 14 is a schematic view illustrating the coating apparatus according to the second embodiment.

FIG. 14 is a schematic view illustrating the coating apparatus according to the second embodiment.

As shown in FIG. 14, the coating apparatus 210 may include a coating member holder 66. The coating member holder 66 holds the coating member 80. The coating member holder 66 moves the coating member 80 relative to the coating head (in the example, the coating head 110).

In the example, the coating member 80 includes a roll-shaped film. The coating member holder 66 includes a first holding mechanism 66*a* and a second holding mechanism 66*b*. The first holding mechanism 66*a* holds a first portion 80*a* of the roll-shaped film (the coating member 80). The second holding mechanism 66*b* holds a second portion 80*b* of the roll-shaped film (the coating member 80). The first holding mechanism 66*a* and the second holding mechanism 66*b* are, for example, rollers.

In the coating apparatus 210, a meniscus of the liquid 84 is formed between the coating bar 10 and the coating member 80; and the liquid 84 is coated onto the coating member 80. The coated film 85 is formed of the liquid 84 on the coating member 80. The target film is obtained by drying and solidifying the coated film 85.

For example, the coating apparatus 210 may include a mechanism that can modify the position of the coating head 110. It is favorable for the coating member 80 to be a roll-shaped film. The coating is possible with high productivity.

As shown in FIG. 14, the position of at least a portion of the coating member holder 66 is higher than the position of the supplier 61. In the example, the position of the first holding mechanism 66*a* is higher than the position of the supplier 61. By such a configuration, for example, the effects of the pulsatory motion of the supplier 61 are easily suppressed.

According to the embodiment, it is favorable for the movement direction 88 of the coating member 80 to be a direction that is upward from below. Thereby, gravity is applied to the meniscus. Even when coating at a high speed, a uniform coated film 85 is easily obtained thereby. The movement direction 88 may be oblique to the vertical direction. The angle between the movement direction 88 and the vertical direction is, for example, not more than 30°.

As shown in FIG. 14, it is favorable for the multiple nozzles 20 to supply the liquid 84 to the coating bar 10 from above the coating bar 10. For example, dripping of the liquid 84 can be suppressed.

According to the embodiment, a joint at which the supply pipe 25 and the nozzle 20 can be detached may be provided.

According to the embodiment, for example, multiple supply pipes 25 that supply the liquid 84 to the multiple nozzles 20 from one tank 65 are provided. Thereby, for example, the liquid can be easily supplied to the multiple nozzles 20 with a uniform pressure.

According to the embodiment, a cleaning mechanism that cleans the coating bar 10 may be provided. For example, the cleaning mechanism sprays or emits a solvent (e.g., water). For example, the cleaning mechanism may be configured to apply an ultrasonic wave. According to the embodiment, a recovery mechanism that recovers the excess liquid may be provided.

Figure 15:
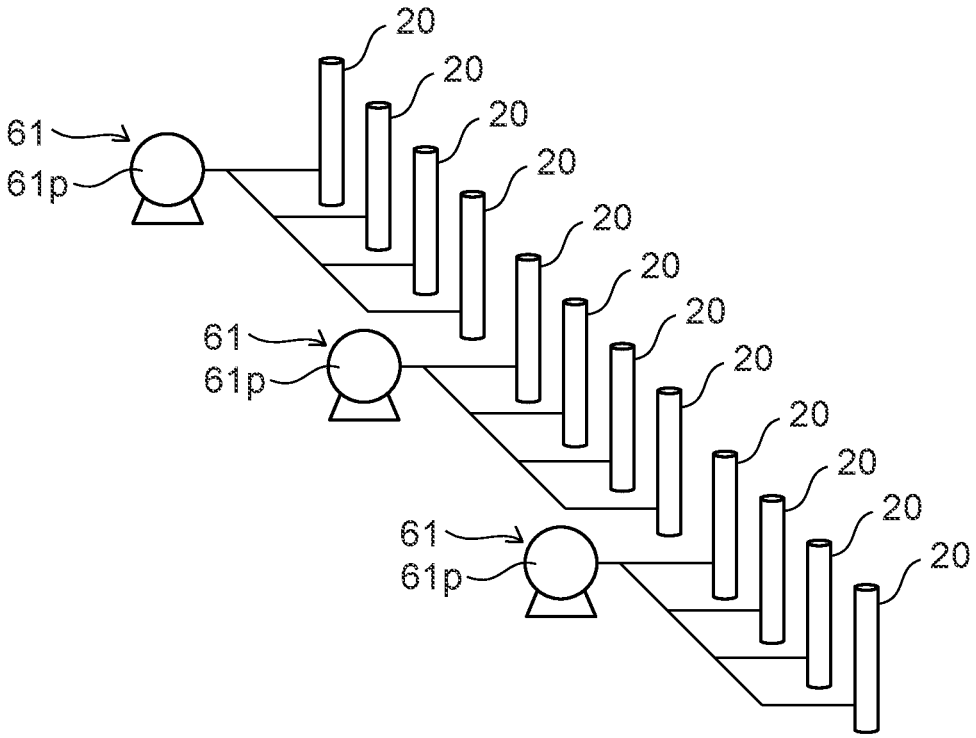
FIG. 15 is a schematic view illustrating the coating apparatus according to the second embodiment.

FIG. 15 is a schematic view illustrating the coating apparatus according to the second embodiment.

As shown in FIG. 15, the supplier 61 may include multiple pumps 61*p*. In the example, the number of the multiple nozzles 20 is an integer multiple of the multiple pumps 61*p*. The number of the pumps 61*p* can be reduced thereby. It is more favorable for the number of the nozzles 20 to which the liquid 84 is supplied from one pump 61*p* to be $2^n$ (n being an integer).

Third Embodiment

A third embodiment relates to a coating method. The coating method according to the embodiment coats the liquid 84 onto the coating member 80 by using the coating head according to the first embodiment. The coating method according to the embodiment coats the liquid 84 onto the coating member 80 by using the coating apparatus according to the second embodiment. A coating method can be provided in which a uniform coated film can be formed.

According to the embodiment, the pitch of the multiple nozzles 20 may be determined based on the viscosity of the liquid 84 and the surface tension of the liquid 84. A processor that outputs an appropriate pitch based on the viscosity and the surface tension may be provided.

For example, a film that is included in a solar cell may be formed by the coating head according to the embodiment. For example, the coating member 80 is a roll-shaped film.

An example of experiment results will now be described. In the experiments, the coating member 80 is a roll-shaped PET film. The width (the length in the Y-axis direction) of the PET film is 300 mm. A light-transmissive conductive film is formed on a roll-shaped film by a sputtering apparatus that is adapted to roll-to-roll. The conductive film is a stacked film of ITO/Ag alloy/ITO. The sheet resistance of the conductive film is about 5Ω/□. The conductive film is patterned into the desired configuration by laser irradiation.

In the experiments, the cross-sectional shape of the coating bar 10 is substantially trapezoidal. The bottom portion of the cross-sectional shape of the coating bar 10 is circular arc-like with a curvature of 80 mm. The length in the Y-axis direction of the coating bar 10 is 300 mm. The coating bar 10 is SUS 303.

The length in the Y-axis direction of the first member 31 is 320 mm. The pitch of the multiple first recesses 31*d* is 20 mm. The cross-sectional shape of the first recess 31*d* is "V-shaped". The length in the Y-axis direction of the multiple third members 33 is 30 mm. The length of the nozzle 20 is about 50 mm. The nozzle 20 includes stainless steel. The inner diameter of the nozzle 20 is 0.8 mm. The nozzle 20 is fixed to the first recess 31*d* of the first member 31 by the second member 32 by using the third member 33 and a spring (the elastic member 35). The supply pipe 25 is connected to the base part 22 of the nozzle 20. The supply pipe 25 is a fluorocarbon resin tube. The base part 22 and the supply pipe 25 are connected by a detachable connection member.

In a first experiment, a first liquid is a PEDOT/PSS aqueous dispersion liquid. The first liquid is one of the liquid 84. For example, a hole transport layer of a solar cell can be made from the first liquid. The first liquid is supplied from the multiple nozzles 20 toward the coating bar 10. The dispense amount of the first liquid from one of the multiple nozzles 20 is, for example, 20 μL/s. The movement speed of the coating member 80 is about 83 mm/s. The coated film 85 of the first liquid is dried in a hot air drying furnace adapted to roll-to-roll.

A second liquid is coated onto the coated film 85 (the hole transport layer) recited above after drying. In the second liquid, 8 mg of PTB7 ([poly{4,8-bis[(2-ethylhexyl)oxy]benzo[1,2-b:4,5-b']dithiophene-2,6-diyl-1t-alt-3-fluoro-2-[(2-ethylhexyl)carbonyl]thieno[3,4-b]thiophene-4,6-diyl}]/p-type semiconductor) and 12 mg of $PC_{70}BM$ ([6,6]phenyl-$C_{71}$-methyl esther butyrate/n-type semiconductor) are dispersed in 1 mL of monochlorobenzene. The second liquid is one of the liquid 84. An organic active layer of a solar cell is formed of the second liquid.

In the coating of the second liquid, the distance between the coating bar 10 and the coating member 80 is 300 μm. In the coating of the second liquid 84, the dispense amount of the second liquid from one of the multiple nozzles 20 is, for example, 40 μL/s. The movement speed of the coating member 80 is about 83 mm/s. The coated film 85 of the second liquid is dried in a hot air drying furnace adapted to roll-to-roll.

In such a first experiment, the thickness unevenness of the coated film 85 of the first liquid and the coated film 85 of the second liquid is not more than 5%.

In a second experiment, the coating bar 10 includes a micro unevenness. The maximum height Rz of the unevenness is about 20 μm. The arithmetic average surface roughness Ra of the unevenness is about 3 μm. In the supply of the first liquid of the second experiment, the dispense amount of the first liquid from one of the multiple nozzles 20 is, for example, 25 μL/s. In the supply of the first liquid of the second experiment, the dispense amount of the first liquid from one of the multiple nozzles 20 is, for example, 45 μL/s. In such a second experiment, the thickness unevenness of the coated film 85 of the first liquid and the coated film 85 of the second liquid is not more than 7%.

In a third experiment, the elastic member 35 is not included in the coating head. Otherwise, the conditions of the third experiment are similar to those of the first experiment. In the third experiment, the thickness unevenness of the coated film 85 of the first liquid is not less than 10%. In the third experiment, the thickness unevenness of the coated film 85 of the second liquid is not less than 10%.

In a fourth experiment, the first recess 31*d* is not provided in the first member 31 of the coating head. Otherwise, the conditions of the fourth experiment are similar to those of the first experiment. In the fourth experiment, the thickness unevenness of the coated film 85 of the first liquid is not less than 15%. In the fourth experiment, the thickness unevenness of the coated film 85 of the second liquid is not less than 15%. In the fourth experiment, the multiple nozzles 20 cannot uniformly contact the coating bar 10.

For example, there is an organic thin film solar cell that uses an organic semiconductor or an organic/inorganic hybrid solar cell. For example, an inexpensive solar cell is obtained by forming the layer included in the solar cell by coating. According to the embodiment, for example, a uniform coated film is obtained by roll-to-roll coating. According to the embodiment, for example, a meniscus is formed between the coating bar 10 and the coating member 80. The positions of the multiple nozzles 20 are determined by being guided by grooves (the first recesses 31*d*). The multiple nozzles 20 are fixed to the first member 31 by using the elastic member 35.

Embodiments include the following configurations (e.g., technological proposals).

Configuration 1

A coating head, comprising:

a coating bar configured to face a coating member;

a plurality of nozzles configured to supply a liquid toward the coating bar;

a first member including a plurality of first recesses;

a plurality of second members;

a plurality of third members, at least a portion of one of the plurality of nozzles being between one of the plurality of first recesses and one of the plurality of third members, the at least a portion of the one of the plurality of nozzles and the one of the plurality of third members being fixed to the first member by one of the plurality of second members;

a plurality of elastic members, one of the plurality of elastic members being located in at least one of a first position, a second position, or a third position, the first position being between the one of the plurality of third members and the one of the plurality of second members, the second position being between the at least a portion of the one of the plurality of first recesses and the one of the plurality of nozzles, the third position being between the at least a portion of the one of the plurality of nozzles and the one of the plurality of third members; and a position controller controlling a relative position between the coating bar and the plurality of nozzles.

Configuration 2

The coating head according to Configuration 1, wherein the plurality of nozzles contacts the coating bar.

Configuration 3

The coating head according to Configuration 1 or 2, wherein the one of the plurality of first recesses extends along a direction in which the at least a portion of the one of the plurality of nozzles extends.

Configuration 4

The coating head according to any one of Configurations 1 to 3, wherein a surface of the coating bar includes an unevenness, and a maximum height Rz of the unevenness is not less than 5 μm and not more than 50 μm.

Configuration 5

The coating head according to any one of Configurations 1 to 4, wherein the plurality of elastic members includes a spring.

Configuration 6

The coating head according to any one of Configurations 1 to 5, wherein the position controller includes an actuator.

Configuration 7

The coating head according to any one of Configurations 1 to 6, wherein at least a portion of the one of the plurality of first recesses is curved.

Configuration 8

The coating head according to any one of Configurations 1 to 7, wherein the one of the plurality of nozzles includes an end surface dispensing the liquid, and an angle between the end surface and an extension direction in which the one of the plurality of nozzles extends is not less than 80 degrees and not more than 100 degrees.

Configuration 9

The coating head according to any one of Configurations 1 to 8, wherein the one of the plurality of nozzles includes a nozzle portion and a base part, the nozzle portion is detachable from the base part, the liquid is supplied to the base part, and the liquid is dispensed from the nozzle portion.

Configuration 10

The coating head according to Configuration 9, wherein the nozzle portion is between the one of the plurality of first recesses and the one of the plurality of third members, and the base part is not between the one of the plurality of first recesses and the one of the plurality of third members.

Configuration 11

The coating head according to any one of Configurations 1 to 10, wherein the coating bar is configured to form a meniscus of the liquid between the coating bar and the coating member.

Configuration 12

The coating head according to any one of Configurations 1 to 11, wherein the one of the plurality of third members includes a second recess, and the at least a portion of the one of the plurality of nozzles is between the second recess and the one of the plurality of first recesses.

Configuration 13

The coating head according to any one of Configurations 1 to 12, wherein the position controller includes:

a first holder holding the coating bar; and a second holder holding the plurality of nozzles, at least one of the first holder or the second holder is configured to apply stress to at least one of the coating bar or the plurality of nozzles, and the stress has at least one of an orientation from the coating bar toward the plurality of nozzles or an orientation from the plurality of nozzles toward the coating bar.

Configuration 14

The coating head according to Configuration 13, wherein at least one of the plurality of nozzles reversibly bends according to the stress.

Configuration 15

A coating apparatus, comprising:

the coating head according to any one of Configurations 1 to 14;

a supplier supplying the liquid to the plurality of nozzles; and a coating member holder holding the coating member and moving the coating member relative to the coating head.

Configuration 16

The coating apparatus according to Configuration 15, wherein the coating member includes a roll-shaped film, and the coating member holder includes:

a first holding mechanism holding a first portion of the roll-shaped film; and a second holding mechanism holding a second portion of the roll-shaped film.

Configuration 17

The coating apparatus according to Configuration 15 or 16, wherein the supplier includes a plurality of pumps, and a number of the plurality of nozzles is an integer multiple of the plurality of pumps.

Configuration 18

The coating apparatus according to any one of Configurations 15 to 17, wherein a position of at least a portion of the coating member holder is higher than a position of the supplier.

Configuration 19

The coating apparatus according to any one of Configurations 15 to 18, further comprising:

a liquid sensor detecting a supply rate of the liquid to the plurality of nozzles; and a supply controller controlling the supplier based on the supply rate detected by the liquid sensor.

Configuration 20

A coating method, comprising:

coating the liquid onto the coating member by using the coating head according to any one of Configurations 1 to 14.

According to embodiments, a coating head, a coating apparatus, and a coating method are provided in which a uniform coated film can be formed.

Hereinabove, embodiments of the invention are described with reference to specific examples. However, the invention is not limited to these specific examples. One skilled in the art may similarly practice the invention by appropriately selecting specific configurations of components such as, for example, the coating bar, the member, the nozzle, the controller, etc., included in the coating head from known art; and such practice is within the scope of the invention to the extent that similar effects can be obtained.

Furthermore, combinations of any two or more components of the specific examples within the extent of technical feasibility are within the scope of the invention to the extent that the purport of the invention is included.

Furthermore, all coating heads, coating apparatuses, and coating methods practicable by an appropriate design modification by one skilled in the art based on the coating head, the coating apparatus, and the coating method described above as embodiments of the invention also are within the scope of the invention to the extent that the purport of the invention is included.

Moreover, various modifications and alterations within the spirit of the invention will be readily apparent to those skilled in the art; and all such modifications and alterations should be seen as being within the scope of the invention.

While certain embodiments of the inventions have been described, these embodiments have been presented by way of example only, and are not intended to limit the scope of the inventions. These novel embodiments may be embodied in a variety of other forms; and various omissions, substitutions, and changes may be made without departing from the spirit of the inventions. Such embodiments and their modifications are within the scope and spirit of the inventions and are included in the inventions described in the claims and their equivalents.

What is claimed is:

1. A coating head, comprising:

a coating bar configured to face a coating member;

a plurality of nozzles configured to supply a liquid toward the coating bar;

a first member including a plurality of first recesses, a plurality of second members;

a plurality of third members, at least a portion of one of the nozzles being between one of the first recesses and one of the third members, the at least a portion of the one of the nozzles and the one of the third members being fixed to the first member by one of the second members;

a plurality of elastic members, one of the elastic members being located in at least one of a first position, a second position, or a third position, the first position being between the one of the third members and the one of the second members, the second position being between the at least a portion of the one of the first recesses and the one of the nozzles, the third position being between the at least a portion of the one of the nozzles and the one of the third members; and a position controller controlling a relative position between the coating bar and the nozzles.

2. The head according to claim 1, wherein the nozzles contact the coating bar.

3. The head according to claim 1, wherein the one of the first recesses extends along a direction in which the at least a portion of the one of the nozzles extends.

4. The head according to claim 1, wherein
a surface of the coating bar includes an unevenness, and
a maximum height Rz of the unevenness is not less than 5 μm and not more than 50 μm.

5. The head according to claim 1, wherein
the elastic members include a spring.

6. The head according to claim 1, wherein
the position controller includes an actuator.

7. The head according to claim 1, wherein
at least a portion of the one of the first recesses is curved.

8. The head according to claim 1, wherein
the one of the nozzles includes an end surface dispensing the liquid, and
an angle between the end surface and an extension direction of the one of the nozzles in which the one of the nozzles extends is not less than 80 degrees and not more than 100 degrees.

9. The head according to claim 1, wherein
the one of the nozzles includes a nozzle portion and a base part,
the nozzle portion is detachable from the base part,
the liquid is supplied to the base part, and
the liquid is dispensed from the nozzle portion.

10. The head according to claim 9, wherein
the nozzle portion is between the one of the first recesses and the one of the third members, and
the base part is not between the one of the first recesses and the one of the third members.

11. The head according to claim 1, wherein
the coating bar is configured to form a meniscus of the liquid between the coating bar and the coating member.

12. The head according to claim 1, wherein
the one of the third members includes a second recess, and
the at least a portion of the one of the nozzles is between the second recess and the one of the first recesses.

13. The head according to claim 1, wherein
the position controller includes:
a first holder holding the coating bar; and
a second holder holding the nozzles,
at least one of the first holder or the second holder is configured to apply stress to at least one of the coating bar or the nozzles, and
the stress has at least one of an orientation from the coating bar toward the nozzles or an orientation from the nozzles toward the coating bar.

14. The head according to claim 13, wherein
at least one of the nozzles reversibly bends according to the stress.

15. A coating apparatus, comprising:
a coating head including a coating bar configured to face a coating member, a plurality of nozzles configured to supply a liquid toward the coating bar, a first member including a plurality of first recesses, a plurality of second members, a plurality of third members, at least a portion of one of the nozzles being between one of the first recesses and one of the third members, the at least a portion of the one of the nozzles and the one of the third members being fixed to the first member by one of the second members, a plurality of elastic members, one of the elastic members being located in at least one of a first position, a second position, or a third position, the first position being between the one of the third members and the one of the second members, the second position being between the at least a portion of the one of the first recesses and the one of the nozzles, the third position being between the at least a portion of the one of the nozzles and the one of the third members, and a position controller controlling a relative position between the coating bar and the nozzles;
a supplier supplying the liquid to the nozzles; and
a coating member holder holding the coating member and moving the coating member relative to the coating head.

16. The apparatus according to claim 15, wherein
the coating member includes a roll-shaped film, and
the coating member holder includes:
a first holding mechanism holding a first portion of the roll-shaped film; and
a second holding mechanism holding a second portion of the roll-shaped film.

17. The apparatus according to claim 15, wherein
the supplier includes a plurality of pumps, and
a number of the nozzles is an integer multiple of the pumps.

18. The apparatus according to claim 15, wherein
a position of at least a portion of the coating member holder is higher than a position of the supplier.

19. The apparatus according to claim 15, further comprising:
a liquid sensor detecting a supply rate of the liquid to the plurality of nozzles; and
a supply controller controlling the supplier based on the supply rate detected by the liquid sensor.

20. A coating method, comprising:
coating a liquid onto a coating member by using a coating head, the coating head including a coating bar configured to face the coating member, a plurality of nozzles configured to supply the liquid toward the coating bar, first member including a plurality of first recesses, a plurality of second members, a plurality of third members, at least a portion of one of the nozzles being between one of the first recesses and one of the third members, the at least a portion of the one of the nozzles and the one of the third members being fixed to the first member by one of the second members, a plurality of elastic members, one of the elastic met bergs being located in at least one of a first position, a second position, or a third position, the first position being between the one of the third members and the one of the second members, the second position being between the at least a portion of the one of the first recesses and the one of the nozzles, the third position being between the at least a portion of the one of the nozzles and the one of the third members, and a position controller controlling a relative position between the coating bar and the nozzles.

* * * * *